US009817336B2

(12) United States Patent
Fujimura

(10) Patent No.: US 9,817,336 B2
(45) Date of Patent: Nov. 14, 2017

(54) TONER SUPPLY DEVICE INCLUDING OPENING AND CLOSING MECHANISM OF TONER SUPPLY PORT, AND IMAGE FORMING APPARATUS

(71) Applicant: KYOCERA Document Solutions Inc., Osaka-shi, Osaka (JP)

(72) Inventor: Takeshi Fujimura, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/360,328

(22) Filed: Nov. 23, 2016

(65) Prior Publication Data

US 2017/0153576 A1 Jun. 1, 2017

(30) Foreign Application Priority Data

Nov. 26, 2015 (JP) ..... 2015-231018

(51) Int. Cl.
*G03G 15/08* (2006.01)

(52) U.S. Cl.
CPC ..... *G03G 15/0877* (2013.01); *G03G 15/0817* (2013.01); *G03G 15/0881* (2013.01)

(58) Field of Classification Search
CPC ..... G03G 15/0817; G03G 15/0877; G03G 15/0879; G03G 15/0881
See application file for complete search history.

(56) References Cited

U.S. PATENT DOCUMENTS

2011/0052266 A1* 3/2011 Yoon ..... G03G 21/1814 399/258
2013/0243492 A1* 9/2013 Shimizu ..... G03G 15/0879 399/260

FOREIGN PATENT DOCUMENTS

JP 2004258472 A 9/2004

* cited by examiner

*Primary Examiner* — David M Gray
*Assistant Examiner* — Michael Harrison
(74) *Attorney, Agent, or Firm* — Alleman Hall Creasman & Tuttle LLP

(57) ABSTRACT

A toner supply device includes a toner guide, an opening and closing member, and a biasing member. The toner guide guides toner toward a toner supply port. The opening and closing member opens and closes the toner supply port by moving. The biasing member biases the opening and closing member in a closing direction. The opening and closing member includes a base portion, an extension portion, and a toner receiving portion. The base portion faces and closes the toner supply port at the closing position. The extension portion extends downward from an edge of an end portion of the base portion, wherein the edge faces in the closing direction. The toner receiving portion is contracted upon receiving a pressing force in an opening direction, and is expanded upon disappearing of the pressing force and receives toner that has fallen down from the end portion of the base portion.

11 Claims, 9 Drawing Sheets

TONER SUPPLY DEVICE INCLUDING OPENING AND CLOSING MECHANISM OF TONER SUPPLY PORT, AND IMAGE FORMING APPARATUS

INCORPORATION BY REFERENCE

This application is based upon and claims the benefit of priority from the corresponding Japanese Patent Application No. 2015-231018 filed on Nov. 26, 2015, the entire contents of which are incorporated herein by reference.

BACKGROUND

The present disclosure relates to an opening and closing mechanism for opening and closing a toner supply port of a toner guide by using an opening and closing member, and in particular, relates to a toner supply device and an image forming apparatus configured to prevent toner leaked from a toner supply port from pouring down from an opening and closing member when the opening and closing member is opened and closed.

A developing device is installed in an image forming apparatus, such as a copier or a printer, that forms an image on a print sheet by the electrophotography. Developer containing toner is stored in the developing device. The developing device develops an electrostatic latent image formed on an image carrying member such as a photoconductor drum, by the toner contained in the developer. As the developing is performed, the toner stored in the developing device is reduced. As a result, the image forming apparatus includes a toner container storing toner, and the toner is supplied from the toner container to the developing device. Conventionally, the image forming apparatus includes a toner supply device that supplies the toner from the toner container to the developing device. The toner supply device includes a toner guide that guides the toner to a predetermined position. The toner guide includes a toner supply port and an opening and closing member (shutter member). The toner is supplied to the developing device via the toner supply port. The opening and closing member opens and closes the toner supply port.

According to a conventional image forming apparatus, the developing device is attached, in a detachable manner, to a housing of the image forming apparatus so that the developing device can be replaced. In this type of image forming apparatus, an opening and closing member is moved from a closing position of closing the toner supply port to an opening position interlockingly with the attachment operation of the developing device to the housing. In addition, when the developing device is attached to the housing, a toner replenishing port of the developing device is positioned and aligned with the toner supply port. This allows the developing device to receive toner supplied from the toner supply port. In addition, the opening and closing member is biased by a spring or the like in a closing direction directed from the opening position to the closing position, and when the developing device is pulled out from the housing, the opening and closing member is moved to the closing position by the biasing force of the spring.

SUMMARY

A toner supply device according to an aspect of the present disclosure includes a toner guide, an opening and closing member, and a biasing member. The toner guide has a toner supply port in a lower end portion thereof and configured to guide toner toward the toner supply port. The opening and closing member is configured to open and close the toner supply port by moving between a closing position for closing the toner supply port and an opening position for opening the toner supply port. The biasing member is configured to bias the opening and closing member in a closing direction directed from the opening position to the closing position. The opening and closing member includes a base portion, an extension portion, and a toner receiving portion. The base portion is configured to face and close the toner supply port when the opening and closing member is located at the closing position. The extension portion extends downward from an edge of an end portion of the base portion, wherein the edge faces in the closing direction. The toner receiving portion is provided on a side surface of the extension portion that faces in the closing direction and configured to be contracted upon receiving a pressing force in an opening direction opposite to the closing direction, and be expanded upon disappearing of the pressing force and receive toner that has fallen down from the end portion of the base portion.

An image forming apparatus according to another aspect of the present disclosure includes a toner guide, a developing device, an attachment portion, an opening and closing member, and a biasing member. The toner guide has a toner supply port in a lower end portion thereof and configured to guide toner toward the toner supply port. The developing device includes a toner replenishing portion through which the toner supplied from the toner supply port downward enters an inside of the developing device. The attachment portion is configured to support the developing device in a detachable manner at an attachment position such that the developing device can be moved from the attachment position in a first direction of going away horizontally therefrom, wherein the toner is supplied from the toner supply port and replenished to a replenishing port of the toner replenishing portion when the developing device is located at the attachment position and the toner replenishing portion is in contact with the toner supply port. The opening and closing member is configured to move interlockingly with an attachment or detachment operation of the developing device with respect to the attachment portion, move to a closing position for closing the toner supply port when the developing device is moved in the first direction, and move to an opening position for opening the toner supply port by being pressed in a second direction by the toner replenishing portion when the developing device is moved in the second direction to the attachment position. The biasing member is configured to bias the opening and closing member in a closing direction directed from the opening position to the closing position. The opening and closing member includes a base portion, an extension portion, and a toner receiving portion. The base portion is configured to face and close the toner supply port when the opening and closing member is located at the closing position. The extension portion extends downward from an edge of an end portion of the base portion, wherein the edge faces in the closing direction. The toner receiving portion is provided on a side surface of the extension portion that faces in the closing direction, at a position where the toner receiving portion is pressed by the toner replenishing portion when the developing device is moved to the attachment position, and configured to be contracted upon receiving a pressing force of the toner replenishing portion, and be expanded upon disappearing of the pressing force and receive toner that has fallen down from the end portion of the base portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
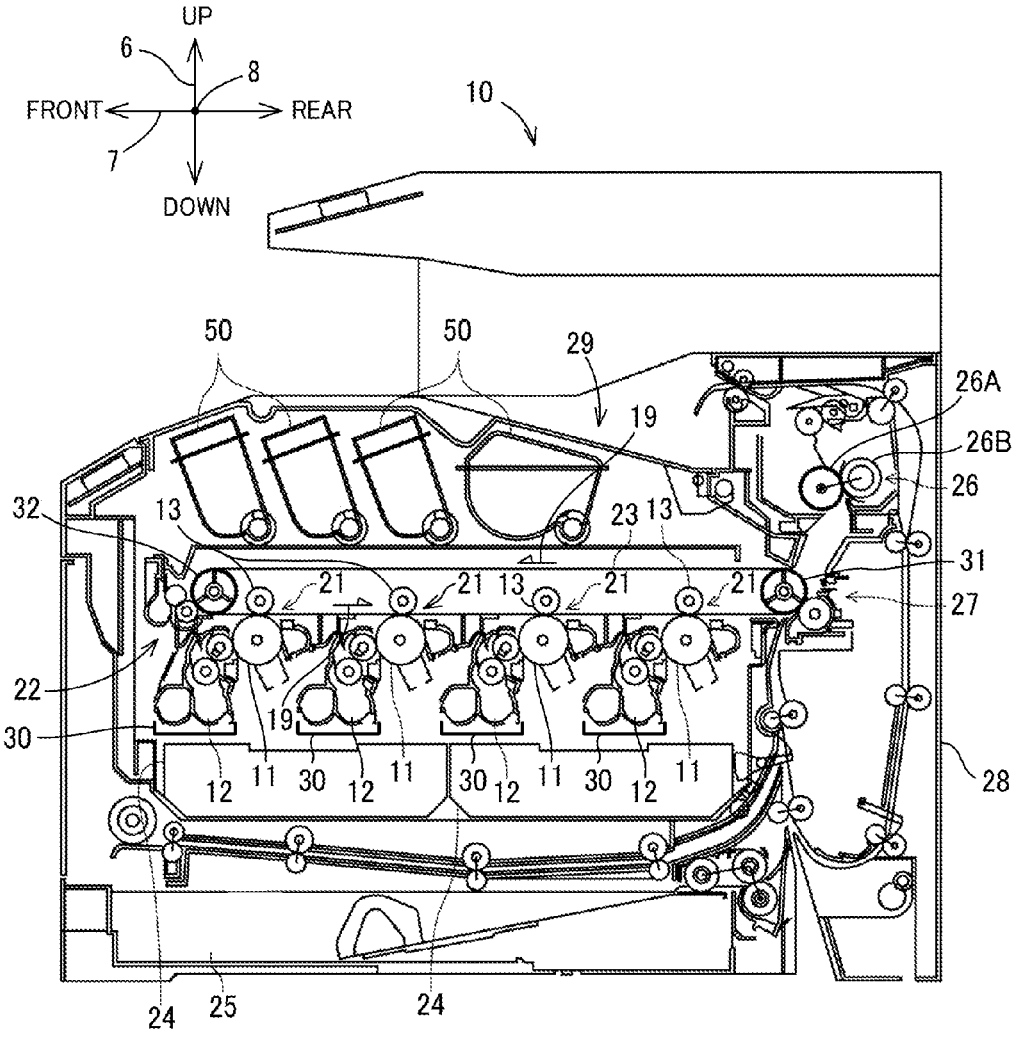
FIG. 1 is a diagram showing a configuration of an image forming apparatus according to an embodiment of the present disclosure.

The following describes an embodiment of the present disclosure with reference to the attached drawings. It should be noted that the following embodiment is an example of a specific embodiment of the present disclosure and should not limit the technical scope of the present disclosure. For the sake of explanation in the following description, an up-down direction 6 is defined based on a state where an image forming apparatus 10 according to the embodiment of the present disclosure is installed (the state shown in FIG. 1). In addition, a front-rear direction 7 is defined on a supposition that the left of the plane of FIG. 1 is the front side of the image forming apparatus 10. In addition, a left-right direction 8 (a direction vertical to the plane of FIG. 1) is defined on a supposition that the image forming apparatus 10 shown in FIG. 1 is viewed from the front side thereof. As a result, the front side of the plane of FIG. 1 is the right side, and the depth side of the plane of FIG. 1 is the left side.

[Image Forming Apparatus]

The image forming apparatus 10 has at least a print function. As shown in FIG. 1, the image forming apparatus 10 is, for example, a so-called tandem-type color printer. The image forming apparatus 10 prints an image on a print sheet by using developer containing toner. It is noted that the image forming apparatus 10 is not limited to such a printer, but may be any apparatus having the print function such as a facsimile apparatus, a copier, or a multifunction peripheral having a plurality of functions including the print function. Of course, the image forming apparatus 10 may not form a color image, but form a monochrome image.

As shown in FIG. 1, the image forming apparatus 10 includes, as major components, four image forming portions 21, an intermediate transfer unit 22, a sheet feed device 25, a fixing device 26, a secondary transfer device 27, an exposure device 24, four toner containers 50 (50A-50D), and a toner supply device 60. These components are attached to a housing 28 (an example of the apparatus main body) that constitutes an external frame (not shown) and an internal frame (not shown) of the image forming apparatus 10.

The four image forming portions 21 are disposed below the intermediate transfer unit 22 in the housing 28. The image forming portions 21 are aligned along the front-rear direction 7. The image forming portions 21 form toner images respectively on photoconductor drums 11, and transfer the toner images to a transfer belt 23 provided in the intermediate transfer unit 22 by overlaying the toner images onto the belt in sequence. The transfer belt 23 moves in a direction indicated by the arrow 19, and the toner images are transferred in sequence to the transfer belt 23 while it is moving. In the example shown in FIG. 1, in order from the downstream side in the movement direction of the transfer belt 23 (the direction of the arrow 19), the image forming portions 21 for black, yellow, cyan and magenta are disposed in a row in the housing 28.

The image forming portions 21 print an image on a print sheet based on image data input from outside via a network communication portion (not shown). Each of the image forming portions 21 includes a photoconductor drum 11, a charging device (not shown), a developing device 12, and a primary transfer device 13. The photoconductor drum 11 carries a toner image on its surface. The charging device charges the surface of the photoconductor drum 11 to a certain potential. The exposure device 24 scans the photoconductor drum 11 with a laser beam based on the image data. This allows an electrostatic latent image to be formed on the surface of the photoconductor drum 11. The developing device 12 develops, with toner, the electrostatic latent image formed on the circumferential surface of the photoconductor drum 11. More specifically, the developing device 12 causes the toner to adhere to the electrostatic latent image on the photoconductor drum 11, thereby developing the electrostatic latent image with the toner, and forms a toner image as a visual image on the surface of the photoconductor drum 11. The primary transfer device 13 transfers the toner image from the rotating photoconductor drum 11 to the transfer belt 23.

Figure 2:
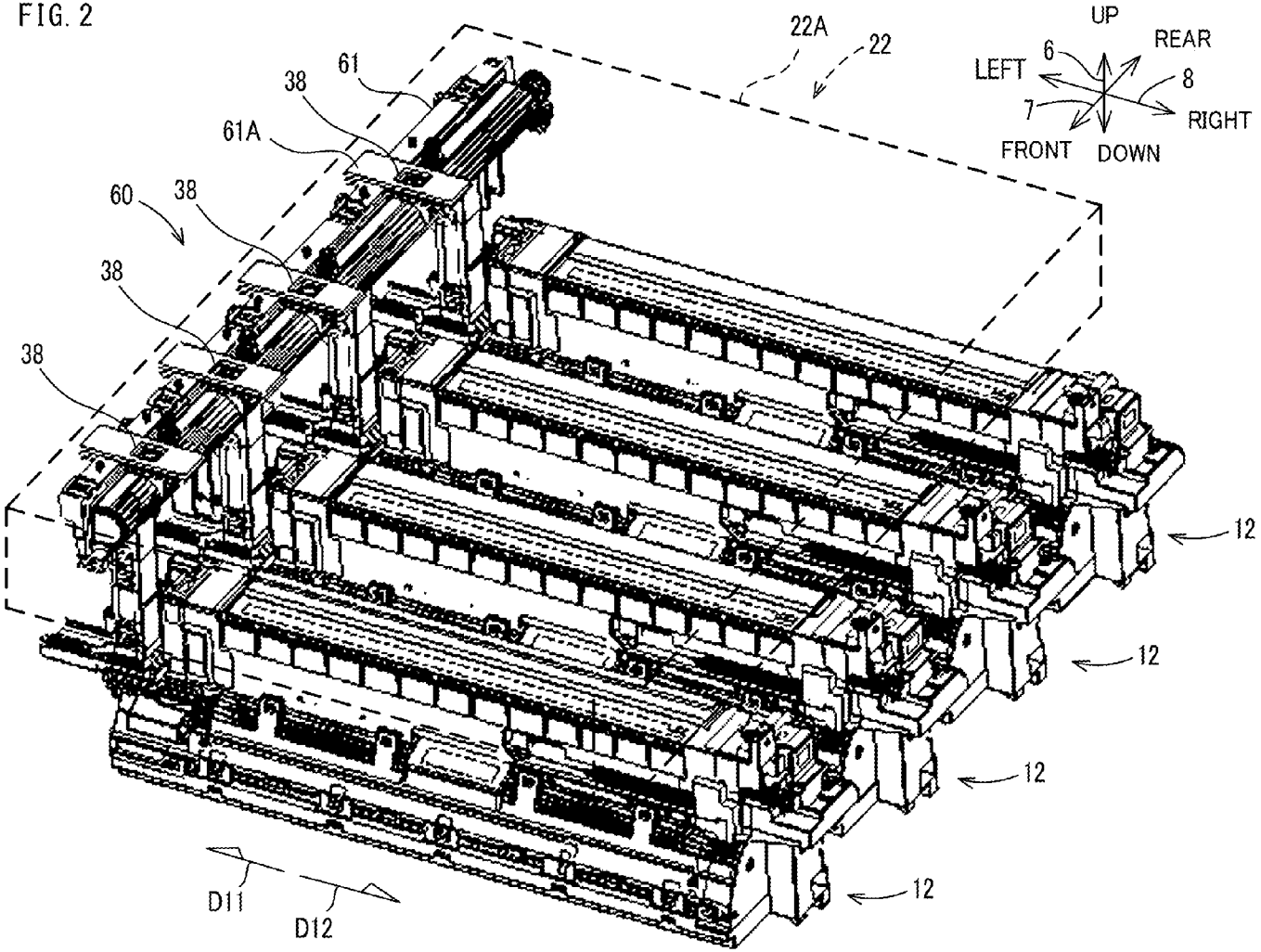
FIG. 2 is a perspective view showing a toner supply device and a developing device according to the embodiment of the present disclosure.
Figure 3:
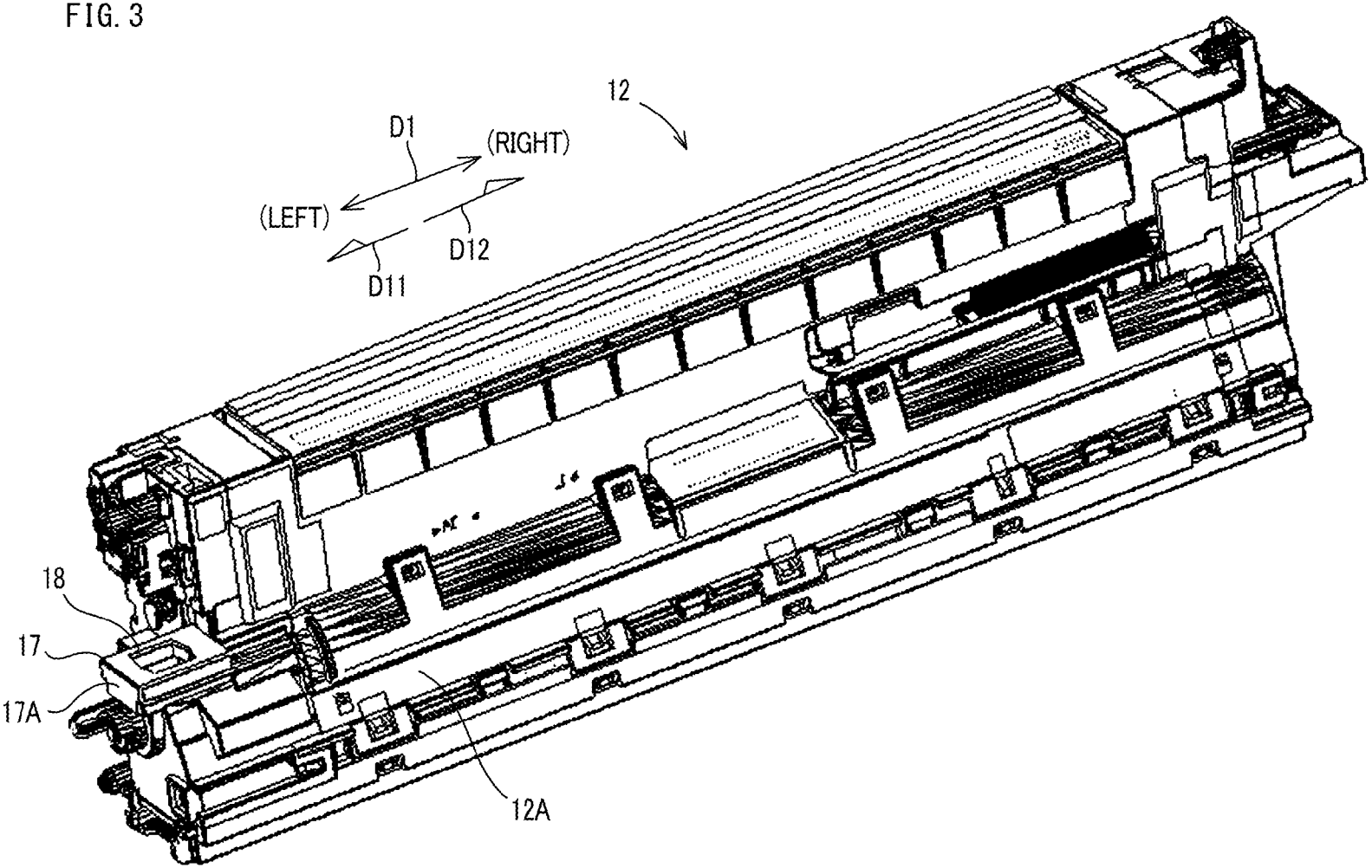
FIG. 3 is a perspective view showing the developing device included in the image forming apparatus.

The developing device 12 performs the developing by using the developer that contains the toner. As shown in FIG. 2, the developing device 12 is elongated in the left-right direction 8. A container main body 12A of the developing device 12 includes a toner replenishing portion 17 (see FIG. 3). The toner replenishing portion 17 has a replenishing port 18 (see FIG. 3). As shown in FIG. 3, the toner replenishing portion 17 is provided in the container main body 12A at one of its opposite end portions in a longitudinal direction D1. Specifically, the toner replenishing portion 17 is provided at the left end portion in the state where the developing device 12 is attached to the housing 28.

The developing device 12 is attached to the housing 28 in a detachable manner so that it can be replaced. A support base 30 (an example of the attachment portion) for supporting the developing device 12 is provided on an inner frame of the housing 28. In the present embodiment, the developing device 12 is supported by the support base 30 in such a manner that it can be inserted to and removed from the housing 28 through an opening formed in the right side of the housing 28 (see FIG. 1). When the developing device 12 is inserted in an insertion direction D11 (the second direction) directed from the opening of the housing 28 to the depth side (the left side in FIG. 3) and reaches a predetermined attachment position, the developing device 12 is fixed to the attachment position by a lock mechanism (not shown). FIG. 2 shows a state where the developing devices 12 are attached to the attachment positions. In this state, the toner can be supplied to the inside of the developing device 12 via the replenishing port 18 by the toner supply device 60 described below. In addition, when the lock by the lock mechanism is released, and the developing device 12 is pulled in a direction opposite to the insertion direction D11, namely, in a removal direction D12 (the first direction) of going away horizontally rightward from the attachment position, and pulled out from the attachment position, the developing device 12 becomes free from the attachment to the housing 28.

As shown in FIG. 1, the intermediate transfer unit 22 is disposed above the image forming portions 21. At opposite ends of the intermediate transfer unit 22 in the front-rear direction 7, a driving pulley 31 and a driven pulley 32 are provided. The transfer belt 23 is supported by the driving pulley 31 and the driven pulley 32 by being suspended therebetween. This allows the transfer belt 23 to move in the direction indicated by the arrow 19. In addition, the transfer belt 23 can move while its surface is in contact with the surfaces of the photoconductor drums 11. When the transfer belt 23 passes through between the photoconductor drums 11 and the primary transfer devices 13, the toner images are transferred from the photoconductor drums 11 to the transfer belt 23 such that the toner images are overlaid with each other in sequence.

The intermediate transfer unit 22 includes a unit main body 22A (see FIG. 4) as a housing. The unit main body 22A, as indicated by the dotted line in FIG. 2, is formed in a rectangular parallelepiped shape such that it is elongated in the front-rear direction 7 and the left-right direction 8, and the size in the up-down direction 6 is shorter than the sizes in the front-rear direction 7 and the left-right direction 8. The unit main body 22A includes the toner supply device 60 described below. Specifically, the toner supply device 60 is provided in the unit main body 22A at the left end portion thereof. The configuration of the toner supply device 60 is described below.

The secondary transfer device 27 is disposed in a rear portion of the housing 28. The secondary transfer device 27 transfers, from the transfer belt 23 to a print sheet, a color toner image formed from the toner images of the plurality of colors. The print sheet with the color toner image transferred thereon is conveyed to the fixing device 26. The fixing device 26 fixes the color toner image transferred to the print sheet, to the print sheet by heat. The fixing device 26 includes a heating roller 26A heated to a high temperature, and a pressure roller 26B disposed to face the heating roller 26A. In the fixing device 26, the print sheet is conveyed while being nipped by a predetermined biasing force at a nip portion between the heating roller 26A and the pressure roller 26B. This allows the color toner image to be fused and adhere to the print sheet. Subsequently, the print sheet is discharged onto a sheet discharge tray 29 provided on an upper part of the housing 28.

As described above, the image forming apparatus 10 forms a color toner image on the surface of the transfer belt 23 by causing the plurality of image forming portions 21 to transfer toner images of different colors onto the running transfer belt 23 such that the toner images are overlaid with each other. The secondary transfer device 27 then transfers the color toner image from the transfer belt 23 to a print sheet. In this way, a color image is formed on the print sheet.

As shown in FIG. 1, the four toner containers 50 are disposed above the intermediate transfer unit 22. Inside the housing 28, the four toner containers 50 are aligned in a row along the transfer belt 23 in the front-rear direction 7. The toner containers 50 store toners of different colors respectively in correspondence with the image forming portions 21. Specifically, the toner containers 50 respectively store toners of black, yellow, cyan and magenta. The toner stored in each of the toner containers 50 is discharged to the toner supply device 60 described below from a toner discharge port (not shown) formed in a bottom portion of the toner container 50, and is supplied to the developing device 12 of the corresponding color by the toner supply device 60.

Figure 4:
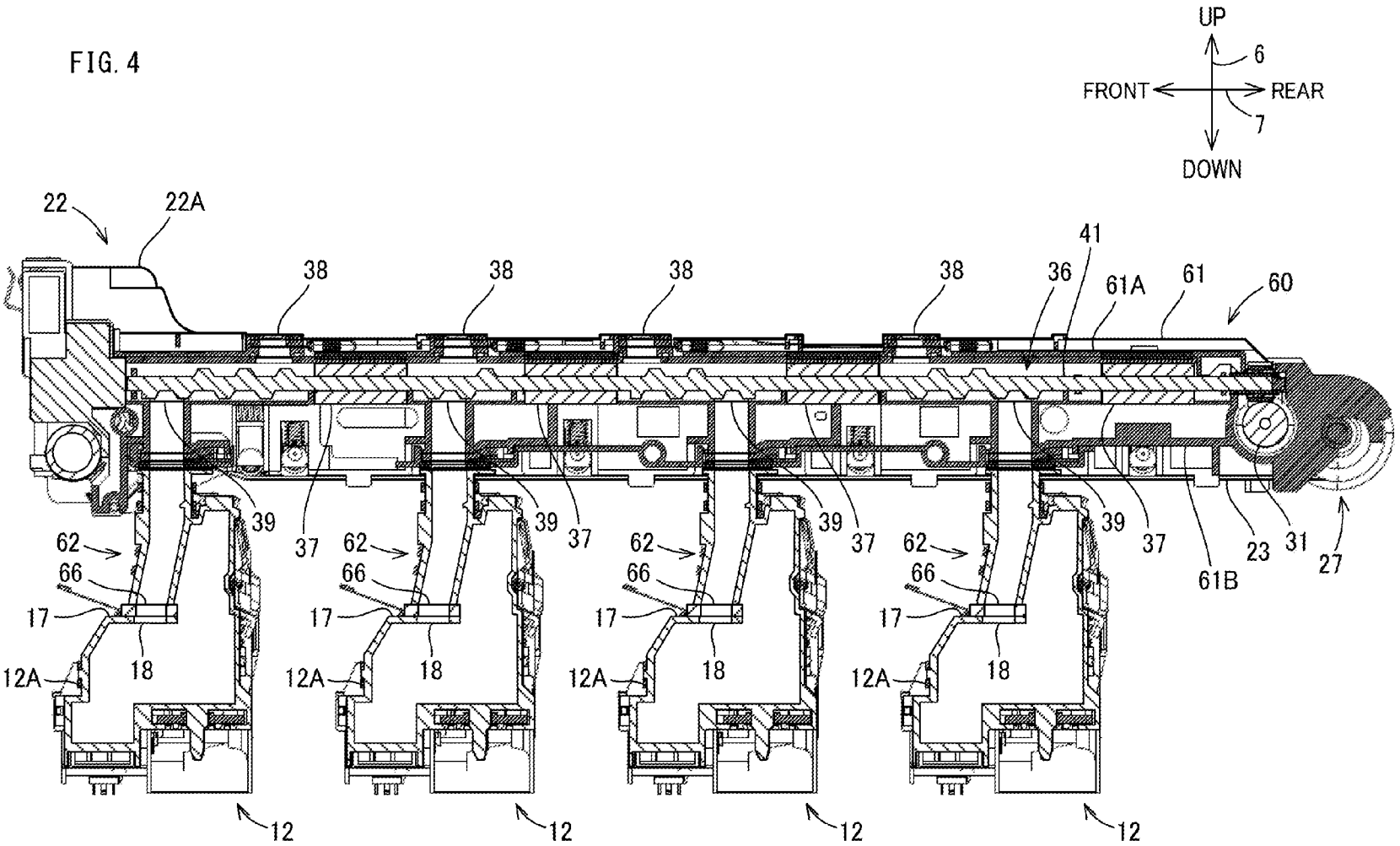
FIG. 4 is a cross-sectional view showing a cross-sectional structure of the toner supply device and the developing device.
Figure 5:
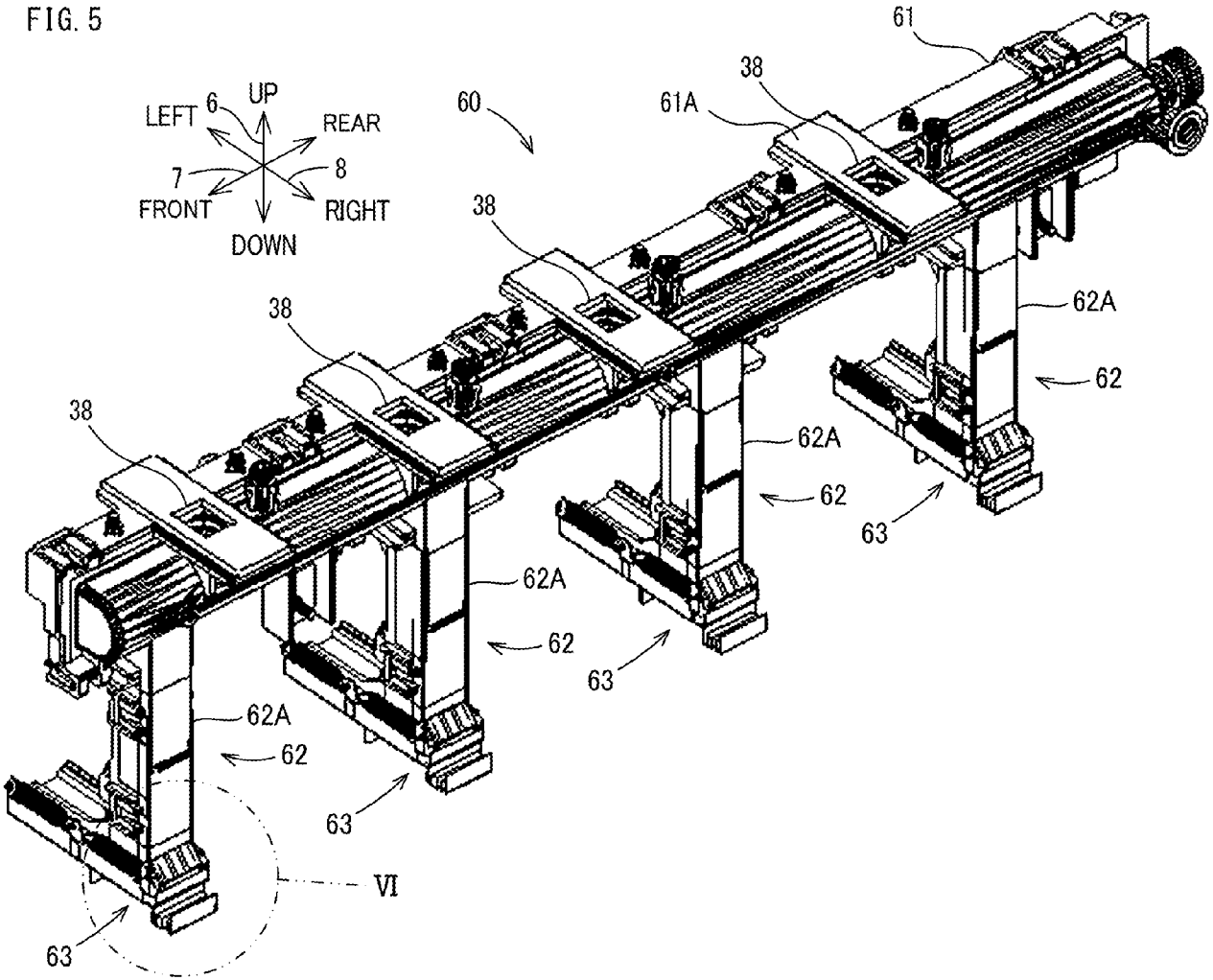
FIG. 5 is a perspective view showing the toner supply device.

FIG. 4 is a cross-sectional view of the toner supply device 60 and the intermediate transfer unit 22 taken along a cutting surface that passes through a toner conveyance path 36 of the toner supply device 60. FIG. 5 is a perspective view showing the toner supply device 60. The toner supply device 60 is provided in the unit main body 22A of the intermediate transfer unit 22, at the left end portion thereof. The toner supply device 60 conveys the toner supplied from the toner containers 50, to the developing devices 12 such that the toner is supplied to an inside of each of the developing devices 12 through the replenishing port 18.

As shown in FIG. 5, the toner supply device 60 roughly includes a toner conveyance portion 61, four toner guides 62, and an opening and closing mechanism 63.

The toner conveyance portion 61 is formed in a rectangular parallelepiped shape elongated in the front-rear direction 7. The toner conveyance portion 61 includes a toner conveyance path 36 for conveying the toner (see FIG. 4). The toner conveyance path 36 is formed in an inside of the toner conveyance portion 61. The toner conveyance path 36 is a passage in which the toner supplied from the toner containers 50 is conveyed to the developing devices 12. In the present embodiment, the toner conveyance path 36 is formed at each portion that connects from a reception port 38 (see FIG. 4) to a communication port 39 provided in each of the toner guides 62, wherein the reception port 38 and the communication port 39 are described below. The toner conveyance path 36 extends in the front-rear direction 7 in the toner conveyance portion 61. The toner conveyance path 36 is divided into four passages in correspondence with the four toner containers 50. In each passage, a portion close to an adjacent passage is sealed with a seal member 37 so that toners of different colors do not mix with each other in the toner conveyance path 36.

As shown in FIG. 4, a spiral shaft 41 for conveying the toner in the toner conveyance path 36, is provided in the toner conveyance path 36. The spiral shaft 41 includes spiral blades that are provided around a rotation shaft. Upon receiving a driving force and being rotated, the spiral shaft 41 conveys the toner in one direction in the toner conveyance path 36. In the present embodiment, the spiral shaft 41 conveys the toner that has been supplied from the toner containers 50 through the reception ports 38 described below, to the communication ports 39 (described below) of the toner guides 62. The toner conveyed to the communication port 39 falls downward as guided by the toner guide 62, and enters the developing device 12 from a lower supply port 66 (an example of the toner supply port) provided at the lower end of the toner guide 62, via the replenishing port 18.

As shown in FIG. 5, a plurality of reception ports 38 are provided respectively in an upper surface portion 61A of the toner conveyance portion 61. In correspondence with the four toner containers 50, four reception ports 38 are provided in the upper surface portion 61A. The reception ports 38 are disposed along the front-rear direction 7 in the upper surface portion 61A. The reception ports 38 penetrate the upper surface portion 61A downward and are communicated with the toner conveyance path 36. In addition, in the state where a corresponding toner container 50 is attached to the housing 28 (hereinafter, the state is also referred to as a "container attached state"), the reception port 38 is communicated with a toner discharge port (not shown) formed in the toner container 50. That is, in the container attached state, the reception port 38 is located below the toner discharge port. It is noted that, in order to prevent toner leakage from the toner discharge port, the toner discharge port is brought into close contact with the reception port 38 in the container attached state.

Four communication ports 39 are formed in a lower surface portion 61B of the toner conveyance portion 61 (see FIG. 4). The communication ports 39 are provided in correspondence with the passages of the toner conveyance path 36 for different colors. As shown in FIG. 4, the toner guides 62 are provided in correspondence with the communication ports 39 respectively.

Figure 6:
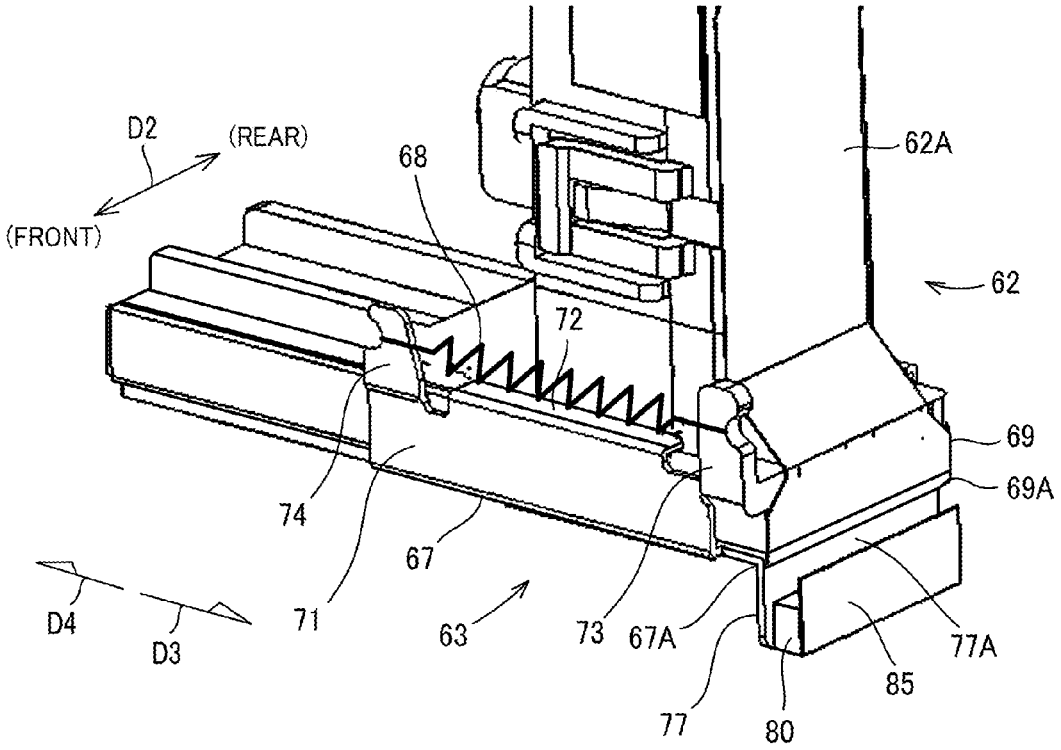
FIG. 6 is an enlarged view of a main part VI of FIG. 5, and a perspective diagram showing a toner guide and an opening and closing mechanism of the toner supply device.
Figure 7:
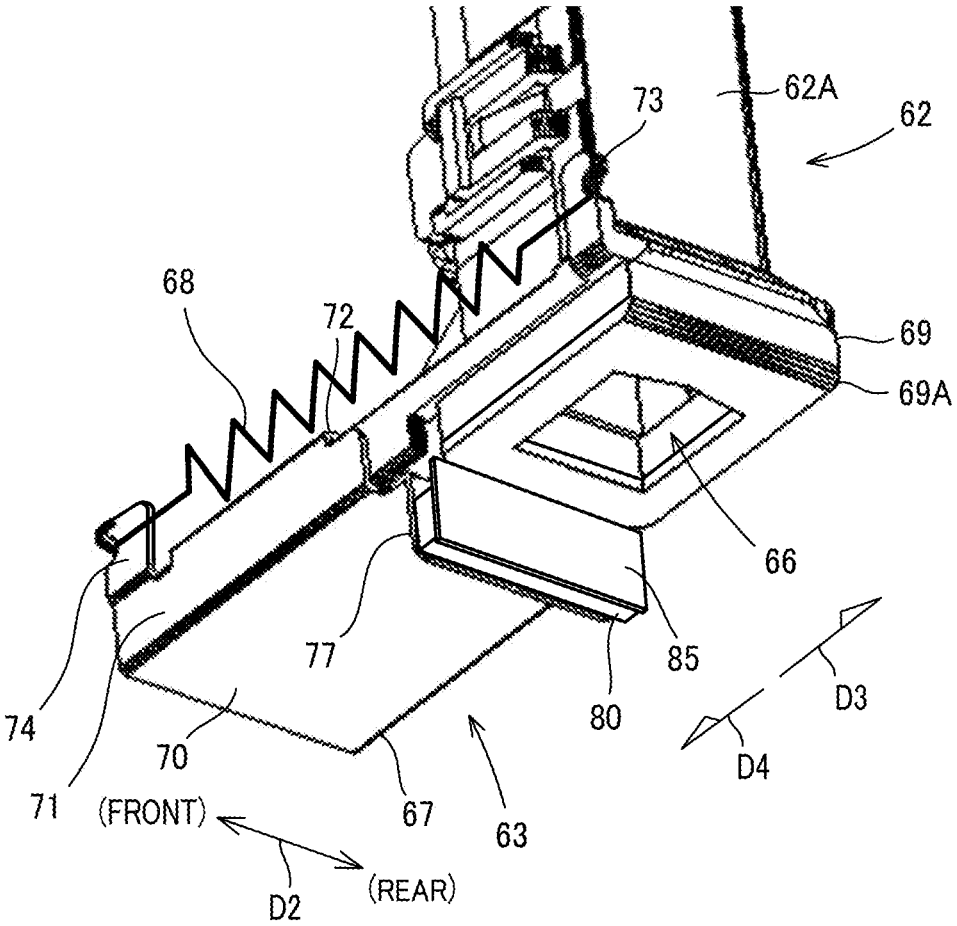
FIG. 7 is a perspective view showing the toner guide and the opening and closing mechanism of the toner supply device.

FIG. 6 and FIG. 7 are enlarged perspective views of the toner guide 62. FIG. 6 is a partially enlarged view of a main part VI of FIG. 5. The toner guide 62 includes a cylindrical guide portion 62A which extends downward from the communication port 39 and whose cross-sectional shape is a square. The inside of the guide portion 62A is a passage in which the toner is conveyed. An upper end of the toner guide 62 is connected to the communication port 39. In a lower end portion of the toner guide 62, a lower supply port 66 (see FIG. 7) is formed. The toner that has flowed from the communication port 39 into the toner guide 62, moves downward by its own weight as guided by the guide portion 62A.

A support member 69 is provided in a lower end portion of the guide portion 62A of the toner guide 62. The support member 69 is formed integrally with the guide portion 62A. The support member 69 is formed in a rectangular parallelepiped shape elongated in the left-right direction 8 (horizontal direction). The support member 69 includes the lower supply port 66 that penetrates it in its thickness direction. The lower supply port 66 is communicated with the inside of the guide portion 62A.

The opening and closing mechanism 63 is attached to the support member 69. As shown in FIG. 6 and FIG. 7, the opening and closing mechanism 63 is composed of a shutter member 67 (an example of the opening and closing member), a spring member 68 (an example of the biasing member) such as a coil spring, and a toner receiving portion 80.

The shutter member 67 is attached to the lower end portion of the toner guide 62. More specifically, the shutter member 67 is attached to a lower surface of the support member 69 so as to be able to slidingly move. That is, the shutter member 67 is slidably supported by the support member 69. The shutter member 67 is configured to open and close the lower supply port 66, and is supported by the support member 69 so as to be able to slidingly move between a closing position (the position shown in FIG. 6) and an opening position (the position shown in FIG. 7), wherein the shutter member 67 at the closing position closes the lower supply port 66, and the shutter member 67 at the opening position opens the lower supply port 66. The shutter member 67 opens and closes the lower supply port 66 by moving between the closing position and the opening position. In the present embodiment, the shutter member 67 is formed from a sheet metal.

Specifically, the shutter member 67 includes a base portion 70 configured to face and close the lower supply port 66 when the shutter member 67 is at the closing position. The base portion 70 is plate-like, and has a flat surface. In addition, the shutter member 67 includes a pair of slide guides 71 that respectively extend upward from two opposite end portions of the base portion 70 in the front-rear direction 7. On the extension ends of the slide guides 71, hook rails 72 are formed, where the hook rails 72 are inwardly bent. The shutter member 67 is attached to the support member 69 such that the pair of slide guides 71 hold opposite ends of the support member 69 in a lateral direction D2. In addition, the hook rails 72 are hooked to upper surfaces of the opposite ends of the support member 69 in the lateral direction D2. With this configuration, the shutter member 67 can slidingly move in the left-right direction 8 with respect to the support member 69.

On the lower surface of the support member 69, an elastic seal member 69A is stuck to a peripheral edge of the lower supply port 66. The seal member 69A is, for example, a sponge member. In the state where the shutter member 67 is disposed at the closing position, the upper surface of the base portion 70 is in contact with the lower surface of the seal member 69A.

As shown in FIG. 6, a spring hook 73 is provided on an upper portion of a right end portion of the support member 69. In addition, a spring hook 74 is provided on an upper portion of a left end portion of the shutter member 67. The spring member 68 is locked to both the spring hook 73 and the spring hook 74. Specifically, in the case where the spring member 68 is a coil spring, one end thereof is fixed to the spring hook 73, and the other end is fixed to the spring hook 74. In the present embodiment, the spring member 68 is a so-called tension spring. As a result, in the state where no external force is applied, the spring member 68 always biases the shutter member 67 in a closing direction D3 directed from the opening position to the closing position side.

In addition, the shutter member 67 includes an extension portion 77 that extends downward from an edge of an end portion 67A of the base portion 70, wherein the edge faces in the closing direction D3. The extension portion 77 is plate-like and extends downward from the end portion 67A. The toner receiving portion 80 is attached to the extension portion 77. In the present embodiment, in the shutter member 67, the base portion 70, the slide guides 71, the hook rails 72, the spring hook 74, and the extension portion 77 are integrally formed from a sheet metal. On the other hand, the toner receiving portion 80 is provided as a different member, independent of the shutter member 67.

In the present embodiment, the extension portion 77 extends downward up to a position where the extension portion 77 is pressed in the insertion direction D11 by an end portion 17A of the toner replenishing portion 17 when the developing device 12 is attached to the attachment position of the housing 28. As a result, when the developing device 12 is moved to the attachment position, the end portion 17A of the toner replenishing portion 17 abuts on the extension portion 77 and presses the shutter member 67 in the insertion direction D11. Upon receiving the pressing force, the shutter member 67 moves from the closing position to the opening position in an opening direction D4 against the biasing force of the spring member 68. This allows the lower supply port 66 to be opened. On the other hand, when the developing device 12 is pulled out from the attachment position in the removal direction D12, the end portion 17A of the toner replenishing portion 17 moves away from the extension portion 77. This eliminates the pressing force that has been applied to the shutter member 67 in the insertion direction D11. The shutter member 67 then moves in the closing direction D3 directed from the opening position to the closing position, by the biasing force of the spring member 68. This causes the lower supply port 66 to be closed.

Meanwhile, when the shutter member 67 is opened and closed, toner leaked from the lower supply port 66 may accumulate on an upper surface of the base portion 70. In that case, when the developing device 12 is pulled out from the attachment position of the housing 28 in the removal direction D12, and the shutter member 67 moves to the closing position, a trace amount of toner that has accumulated on the upper surface of the base portion 70 may move in the removal direction D12, pour down from the end portion 67A of the base portion 70, and smear other members. In view of this, in the present embodiment, the toner receiving portion 80 is provided on the extension portion 77. The toner receiving portion 80 is configured to prevent toner from pouring down when the shutter member 67 closes the lower supply port 66.

The toner receiving portion 80 plays a role of receiving toner that has fallen down from the end portion 67A of the base portion 70. The toner receiving portion 80 is provided on a side surface 77A of the extension portion 77 that faces in the closing direction D3 (see FIG. 6). Upon receiving a pressing force in the opening direction D4 opposite to the closing direction D3, the toner receiving portion 80 is contracted in the opening direction D4, and when the pressing force disappears, the toner receiving portion 80 expands in the closing direction D3. In the present embodiment, the toner receiving portion 80 is in a rectangular parallelepiped shape and formed from an elastic member having holes inside, such as a sponge member. The toner receiving portion 80 is adhered to the side surface 77A by an adhesive or the like.

The toner receiving portion 80 is attached to the side surface 77A of the extension portion 77 at a position where it is pressed by the end portion 17A of the toner replenishing portion 17 when the developing device 12 is inserted in the insertion direction D11 and moved to the attachment position.

In addition, a film member 85 is attached to a side surface of the toner receiving portion 80 that faces in the closing direction D3. The film member 85 is joined to the side surface of the toner receiving portion 80. The film member 85 covers the whole side surface of the toner receiving portion 80 and extends upward from an upper surface of the toner receiving portion 80.

Figure 8A:
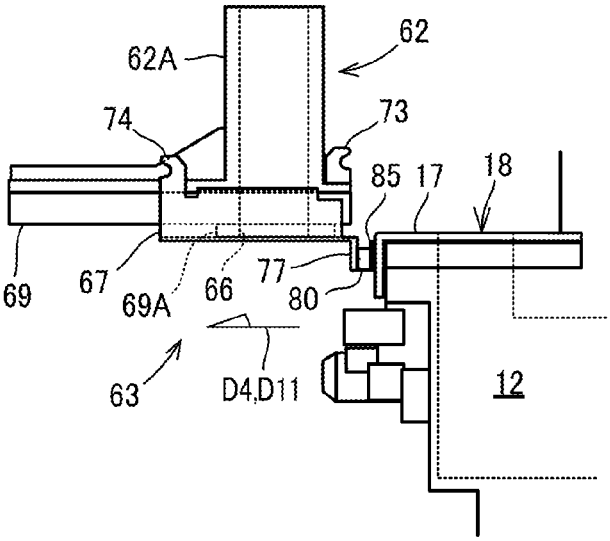
FIG. 8A to FIG. 8C are schematic diagrams showing an operation of the opening and closing mechanism of the toner supply device during a process where the developing device is inserted.
Figure 8B:
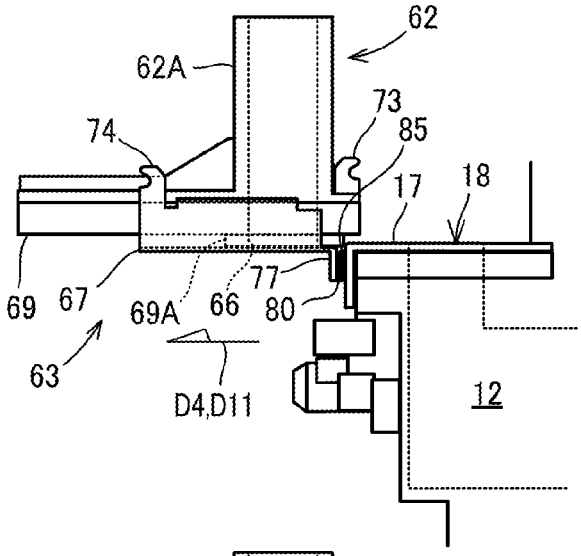
Figure 8C:
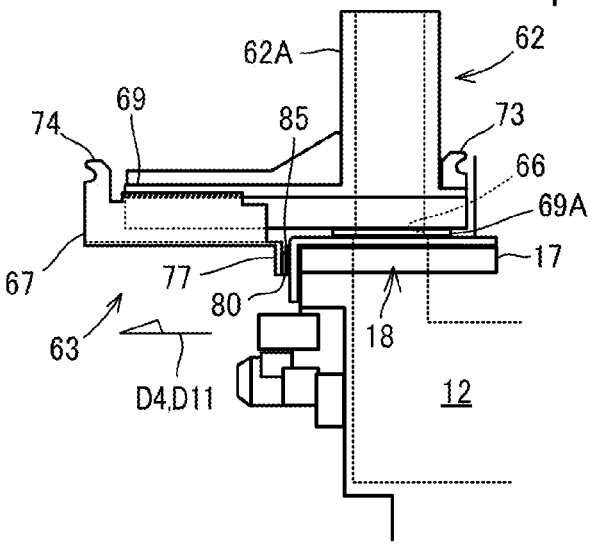

With the above-described configuration of the toner supply device 60, when the developing device 12 is inserted toward the attachment position, the end portion 17A of the toner replenishing portion 17 abuts on the film member 85 (see FIG. 8A). As the developing device 12 is further inserted in the insertion direction D11, the toner receiving portion 80 is contracted by the pressing force of the toner replenishing portion 17 and the biasing force of the spring member 68 (see FIG. 8B). Thereafter, when the developing device 12 is further inserted in the insertion direction D11, the shutter member 67 moves from the closing position to the opening position against the biasing force of the spring member 68 while the toner receiving portion 80 is in the contracted state, and the replenishing port 18 is located below the lower supply port 66 (see FIG. 8C).

In the present embodiment, in the state where the developing device 12 is attached to the attachment position, an upper surface of the toner replenishing portion 17 is positioned higher than a lower surface of the seal member 69A. As a result, during the process where the toner replenishing portion 17 moves the shutter member 67 to the opening position while the toner receiving portion 80 is in the contracted state, the seal member 69A is elastically deformed upward by the upper surface of the toner replenishing portion 17. Therefore, in the state where the developing device 12 is attached to the attachment position, the upper surface of the toner replenishing portion 17 is positioned higher than a contact surface where the upper surface of the base portion 70 is in contact with the lower surface of the seal member 69A.

Here, during the process where the toner replenishing portion 17 moves the shutter member 67 to the opening position, toner that has adhered to the peripheral edge of the seal member 69A may be pushed in the insertion direction D11 by the end portion 17A, and fall on an upper surface of the end portion 67A of the base portion 70. In addition, as described below, during the process where the shutter member 67 moves to the closing position, toner that has adhered to the seal member 69A may be pushed in the removal direction D12, and accumulate on the upper surface of the end portion 67A of the base portion 70.

Figure 9A:
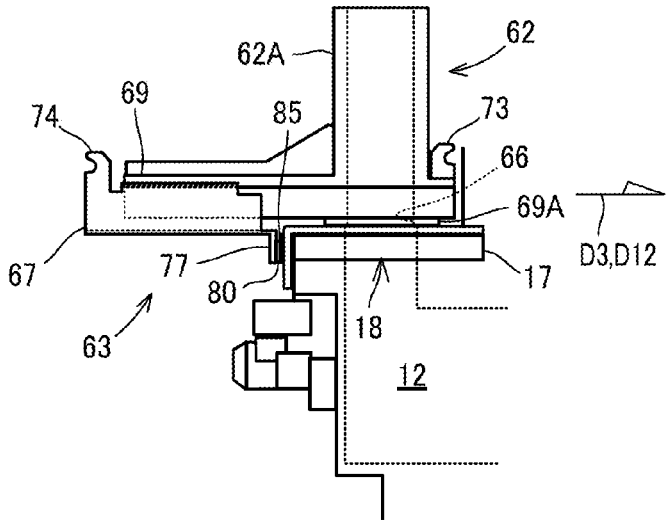
FIG. 9A to FIG. 9C are schematic diagrams showing an operation of the opening and closing mechanism of the toner supply device during a process where the developing device is pulled out.
Figure 9B:
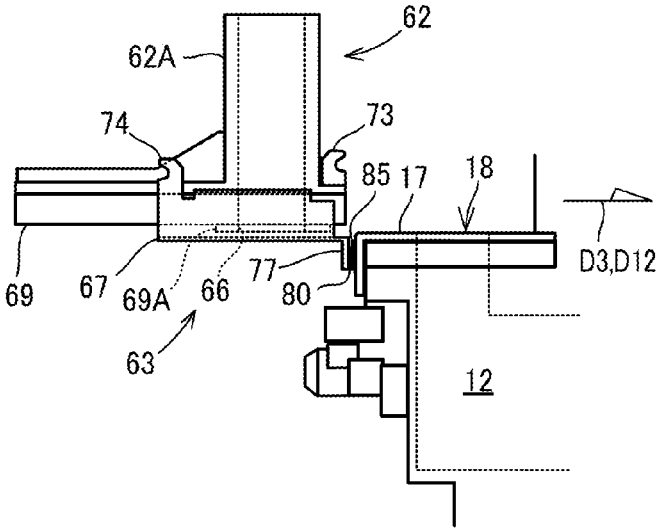
Figure 9C:
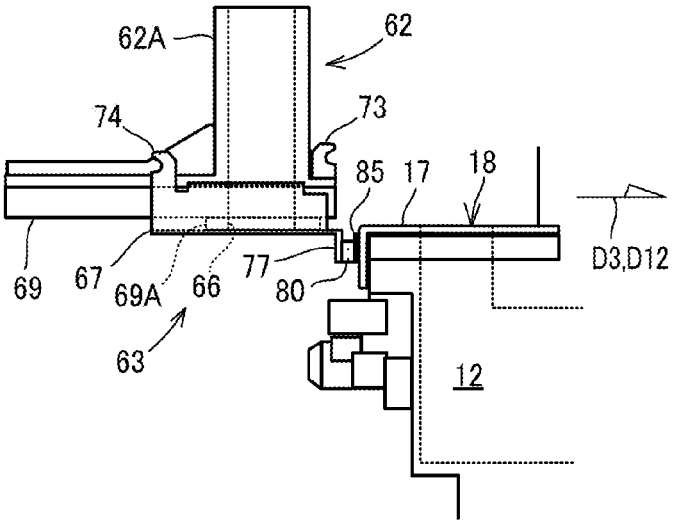

On the other hand, when the developing device 12 is pulled out from the attachment position in the removal direction D12, the shutter member 67, interlockingly with the movement of the developing device 12 during the pull-out, moves from the opening position toward the closing position (see FIG. 9A). Here, the shutter member 67 moves to the closing position while the toner receiving portion 80 is in the contracted state (see FIG. 9B). Subsequently, when the developing device 12 is further pulled out in the removal direction D12, the toner replenishing portion 17 moves away from the toner receiving portion 80 of the shutter member 67. During the process where the toner replenishing portion 17 moves away from the toner receiving portion 80, the toner receiving portion 80 gradually expands from the contracted state, and returns to the original state (see FIG. 9C).

When the developing device 12 is pulled out in the removal direction D12, and the shutter member 67 moves from the opening position to the closing position, toner that has accumulated on the end portion 67A of the base portion 70 may move in the removal direction D12 due to the movement of the seal member 69A, and fall down from the end portion 67A. However, the toner receiving portion 80 expands in the removal direction D12 during the process where the toner replenishing portion 17 moves away from the toner receiving portion 80. As a result, the toner that has fallen down from the end portion 67A is received by the upper surface of the toner receiving portion 80. This prevents toner from falling down and smearing other members.

In addition, since the toner receiving portion 80 is formed from a sponge member, the toner is efficiently caught in the holes provided in the toner receiving portion 80.

In addition, since the film member 85 is attached to the toner receiving portion 80, the toner received by the upper surface of the toner receiving portion 80 is prevented from overflowing and pouring down. It is noted that in the present embodiment, a configuration including the film member 85 is described. However, the film member 85 may not be necessarily provided. As a result, the present disclosure is applicable to a configuration where only the toner receiving portion 80 is attached to the extension portion 77.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner supply device comprising:

a toner guide having a toner supply port in a lower end portion thereof and configured to guide toner toward the toner supply port;

an opening and closing member configured to open and close the toner supply port by moving between a closing position for closing the toner supply port and an opening position for opening the toner supply port; and a biasing member configured to bias the opening and closing member in a closing direction directed from the opening position to the closing position, wherein the opening and closing member includes:

a base portion configured to face and close the toner supply port when the opening and closing member is located at the closing position;

an extension portion extending downward from an edge of an end portion of the base portion, the edge facing in the closing direction; and a toner receiving portion provided on a side surface of the extension portion that faces in the closing direction and configured to be contracted upon receiving a pressing force in an opening direction opposite to the closing direction, and be expanded upon disappearing of the pressing force and receive toner that has fallen down from the end portion of the base portion.

2. The toner supply device according to claim 1, wherein the opening and closing member further includes a film member that is provided on a side surface of the toner receiving portion that faces in the closing direction, and extends upward from an upper surface of the toner receiving portion.

3. The toner supply device according to claim 1, wherein the toner guide includes an elastic seal member on a peripheral edge of the toner supply port.

4. The toner supply device according to claim 1, wherein the toner receiving portion is an elastic member having holes inside.

5. The toner supply device according to claim 1, wherein the opening and closing member is formed from a sheet metal.

6. An image forming apparatus comprising:

a toner guide having a toner supply port in a lower end portion thereof and configured to guide toner toward the toner supply port;

a developing device including a toner replenishing portion through which the toner supplied from the toner supply port downward enters an inside of the developing device;

an attachment portion configured to support the developing device in a detachable manner at an attachment position such that the developing device can be moved from the attachment position in a first direction of going away horizontally therefrom, the toner being supplied from the toner supply port and replenished to a replenishing port of the toner replenishing portion when the developing device is located at the attachment position and the toner replenishing portion is in contact with the toner supply port;

an opening and closing member configured to move interlockingly with an attachment or detachment operation of the developing device with respect to the attachment portion, move to a closing position for closing the toner supply port when the developing device is moved in the first direction, and move to an opening position for opening the toner supply port by being pressed in a second direction by the toner replenishing portion when the developing device is moved in the second direction to the attachment position; and a biasing member configured to bias the opening and closing member in a closing direction directed from the opening position to the closing position, wherein the opening and closing member includes:

a base portion configured to face and close the toner supply port when the opening and closing member is located at the closing position;

an extension portion extending downward from an edge of an end portion of the base portion, the edge facing in the closing direction; and a toner receiving portion provided on a side surface of the extension portion that faces in the closing direction, at a position where the toner receiving portion is pressed by the toner replenishing portion when the developing device is moved to the attachment position, and configured to be contracted upon receiving a pressing force of the toner replenishing portion, and be expanded upon disappearing of the pressing force and receive toner that has fallen down from the end portion of the base portion.

7. The image forming apparatus according to claim 6, wherein the opening and closing member further includes a film member that is provided on a side surface of the toner receiving portion that faces in the closing direction, and extends upward from an upper surface of the toner receiving portion.

8. The image forming apparatus according to claim 6, wherein the toner guide includes an elastic seal member on a peripheral edge of the toner supply port.

9. The image forming apparatus according to claim 6, wherein the toner receiving portion is an elastic member having holes inside.

10. The image forming apparatus according to claim 8, wherein in a state where the developing device is attached to the attachment position, the toner replenishing portion is in contact with the toner supply port via the seal member while elastically deforming the seal member upward, and the opening and closing member at the closing position closes the toner supply port while causing an upper surface of the base portion to be in contact with a lower surface of the seal member.

11. The image forming apparatus according to claim 6, wherein the opening and closing member is formed from a sheet metal.

* * * * *